US008816952B2

(12) United States Patent
Lim

(10) Patent No.: US 8,816,952 B2
(45) Date of Patent: Aug. 26, 2014

(54) APPARATUS AND METHOD FOR DRIVING LAMP OF LIQUID CRYSTAL DISPLAY DEVICE

(75) Inventor: Moo Jong Lim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 493 days.

(21) Appl. No.: 11/111,724

(22) Filed: Apr. 22, 2005

(65) Prior Publication Data

US 2005/0243052 A1 Nov. 3, 2005

(30) Foreign Application Priority Data

Apr. 28, 2004 (KR) ..... 10-2004-0029613

(51) Int. Cl.
*G09G 3/36* (2006.01)

(52) U.S. Cl.
USPC ..... 345/102; 345/87

(58) Field of Classification Search
USPC ..... 345/87, 94, 98–99, 102
See application file for complete search history.

(56) References Cited

U.S. PATENT DOCUMENTS

| | | | | |
|---|---|---|---|---|
| 5,949,633 | A * | 9/1999 | Conway | 361/38 |
| 6,812,916 | B2 * | 11/2004 | Hwang | 345/102 |
| 6,956,555 | B2 * | 10/2005 | Kyomoto | 345/102 |
| 7,145,546 | B2 * | 12/2006 | Kang et al. | 345/102 |
| 2002/0067332 | A1 * | 6/2002 | Hirakata et al. | 345/102 |
| 2004/0004596 | A1 * | 1/2004 | Kang et al. | 345/102 |

FOREIGN PATENT DOCUMENTS

JP 2002100496 A * 4/2002

* cited by examiner

*Primary Examiner* — Jason Mandeville
(74) *Attorney, Agent, or Firm* — McKenna Long & Aldridge LLP

(57) ABSTRACT

An apparatus for driving a lamp of a liquid crystal display device includes a control signal generator generating a switching control signal, a waveform modulator modulating at least an amplitude of the switching control signal to generate a modulated switching control signal, and an AC waveform generator converting a supply voltage based on the modulated switching control signal to generate an AC waveform for driving the lamp, the AC waveform including at least two different peak-to-peak amplitudes within a time period.

2 Claims, 13 Drawing Sheets

APPARATUS AND METHOD FOR DRIVING LAMP OF LIQUID CRYSTAL DISPLAY DEVICE

The present invention claims the benefit of Korean Patent Application No. P2004-29613 filed in Korea on Apr. 28, 2004, which is hereby incorporated by reference.

BACKGROUND OF THE INVENTION

1. Field of the Invention

The present invention relates to a liquid crystal display device, and more particularly to an apparatus and a method for driving a lamp of a liquid crystal display device that provide an improved range of lamp brightness.

2. Discussion of the Related Art

In general, a liquid crystal display (LCD) device controls light transmittance of liquid crystal cells in accordance with data signals using a plurality of control switches, to thereby display an image. Further, an LCD device has broad applications in office automation equipment and audio/video equipment, because of its high image quality, lightness, thin thickness, compact size, and low power consumption.

An LCD device is a non-self-luminous display device and requires an external light source, such as a backlight device. There are two types of LCD backlight devices: a direct type and a light guide type. The direct type backlight device has a plurality of lamps arranged in a plane and a diffusion plate installed between the lamps and a liquid crystal display panel to fixedly maintain a distance between the lamps and the liquid crystal display panel. In contrast, the light guide type backlight device has a lamp installed at an outer area of a flat panel and a transparent light guide to direct light onto an entire-surface of the liquid crystal panel.

FIG. 1 is a schematic block diagram illustrating a liquid crystal display device according to the related art. In FIG. 1, an LCD device includes a liquid crystal display panel 20 having liquid crystal cells Clc arranged in a matrix-like manner at intersections between data lines DL and gate lines GL. In particular, the liquid crystal display panel 20 has liquid crystal formed between an upper substrate and a lower substrate and includes a spacer (not shown) for fixedly maintaining a distance between the upper substrate and the lower substrate. A color filter, a common electrode, and a black matrix (not shown) are formed on the upper substrate of the liquid crystal display panel 20, and a thin film transistor TFT is formed in each of the liquid crystal cells Clc on the lower substrate of the liquid crystal display panel 20.

In addition, an LCD driving apparatus includes a data driver 4 for applying data signals to the data lines DL, a gate driver 6 for applying gate signals to the gate lines GL, and a timing controller 8 for controlling the data driver 4 and the gate driver 6. For example, the thin film transistor TFT of each of the liquid crystal cells Clc applies a data signal from a respective one of the data lines DL to the liquid crystal cell Clc in response to a scanning signal from a respective one of the gate lines GL. Accordingly, the thin film transistor TFT is turned on when a scanning signal from the respective gate line GL, i.e., a gate high voltage, is supplied thereto, thereby supplying a pixel signal from the data line DL to the liquid crystal cell Clc. Further, the thin film transistor TFT is turned off when a gate low voltage from the respective gate line GL is supplied thereto, thereby maintaining the pixel signal charged in the liquid crystal cell Clc.

In FIG. 1, the liquid crystal cell Clc is expressed as a capacitor equivalent and also includes a pixel electrode (not shown) connected to the thin film transistor TFT and facing the common electrode with the liquid crystal therebetween. Further, each of the liquid crystal cells Clc includes a storage capacitor Cst for stably maintaining the charged pixel signal till the next pixel signal is charged. The storage capacitor Cst is formed between the previous gate line and the pixel electrode. As a result, in the liquid crystal cell Clc, the arrangement state of the liquid crystal having dielectric anisotropy is changed in accordance with the pixel signal charged through the thin film transistor TFT to control light transmissivity, such that the liquid crystal cell realizes gray.

The timing controller 8 may re-align a digital video data supplied from a digital video card (not shown) by red, green and blue. The video data re-aligned by the timing controller 8 is supplied to the data driver 4. Also, the timing controller 8 generates a data control signal and a gate control signal by use of a horizontal/vertical synchronization signal. The data control signals including a dot clock, a source shift clock, a source output enable, and a polarity inversion signal are supplied to the data driver 4. The gate signals including a gate start pulse, a gate shift clock, and a gate output enable are supplied to the gate driver 6.

In addition, the data driver 4 supplies the pixel signals of one line portion to the data lines DL every horizontal line in response to the data control signals from the timing controller 8. In particular, the data driver 4 converts the digital video data from the timing controller 8 into an analog video signal by use of a gamma voltage from a gamma voltage generator (not shown). The data driver 4 includes a plurality of data drive integrated circuit (hereinafter, referred to as "IC") which are separately driving the data lines DL. Further, the gate driver 6 sequentially supplies the gate high voltage to the gate lines GL in response to the gate control signals from the timing controller 8, and supplies the gate low voltage in the remaining period when the gate high voltage is not supplied to the gate lines GL.

Furthermore, the LCD driving apparatus includes an inverter circuit 50 for driving a backlight unit 30. The inverter circuit 50 applies a driving voltage or a driving current for driving the backlight unit 30. The backlight unit 30 generates light corresponding to the driving voltage or the driving current from the inverter circuit 50 to irradiate light to the liquid crystal display panel 20.

FIG. 2 is a schematic block diagram of the inverter circuit shown in FIG. 1. As shown in FIG. 2, the backlight unit 30 includes a lamp 21 to generate light. The lamp 21 includes a glass tube, an inert gas within the glass tube, a high voltage electrode at one end of the glass tube, and a low voltage electrode at another end of the glass tube. The inert gas is charged in the glass tube, and phosphorus is spread over the inner wall of the glass tube. For example, if a high AC voltage 24 is applied from the inverter circuit 50 to the lamp 21, electrons are emitted from the low voltage electrode to collide with the inert gas inside the glass tube, thereby increasing the amount of electrons by geometrical progression. The increased electrons cause electric current to flow in the inside of the glass tube, thus the inert gas is excited to emit ultraviolet ray. The ultraviolet ray collides with the luminous phosphorus spread over the inner wall of the glass tube to then emit a visible ray.

The inverter circuit 50 includes an inverter IC 32, a transformer 34, a feedback circuit 36, and a pulse width modulation (PWM) circuit 38. The inverter IC 32 includes at least one switching device (not shown) to convert a supply voltage Vcc supplied from a voltage source (not shown) into an AC waveform. The AC waveform is supplied to the transformer 34 to form the high AC voltage 24, and the high AC voltage 24 then is supplied to the backlight unit 30 (shown in FIG. 1) to drive the lamp 21. In particular, the AC waveform is induced by the winding ratio of the primary winding and the secondary winding of the transformer 34, and the high AC voltage waveform 24 induced by the secondary winding of the transformer 34 is supplied to the high voltage electrode of the lamp 21.

In addition, the feedback circuit 36 detects a tube current of the lamp 21 and outputs a feedback signal FB to the PWM circuit 38. The feedback circuit 36 includes a resistor, a diode and the like, and generates the feedback signal FB to correspond to the tube current. Further, the PWM circuit 38 generates a switching control signal SCS to control the switching device of the inverter IC 32 based on the feedback signal FB.

FIG. 3 is a waveform diagram illustrating an AC voltage waveform for driving the lamp shown in FIG. 2 in a continuous mode. As shown in FIG. 3, in a continuous mode, the AC voltage waveform 24 continuously oscillates between the positive and negative peak voltages. As a result, when a continuous mode driving method is employed, the lamp 21 (shown in FIG. 2) is on continuously.

FIG. 4 is a waveform diagram illustrating an AC voltage waveform for driving the lamp shown in FIG. 2 in a burst mode. As shown in FIG. 4, in a burst mode, the AC voltage waveform 24 oscillates between the positive and negative peak voltages only during a first designated period Ton and remains at zero during a second designed period Toff within a time period T. As a result, when a burst mode driving method is employed, the lamp 21 (shown in FIG. 2) is on only during the first designated period Ton.

FIG. 5 is a graph illustrating brightness of the lamp when the AC voltage waveforms shown in FIGS. 3 and 4 are applied thereto. In FIG. 5, a solid line A represents brightness of the lamp 21 (shown in FIG. 2) when the AC voltage waveform of the continuous mode driving method shown in FIG. 3 is applied thereto. For example, the continuous mode driving method provides a brightness range of 300 nit to 390 nit corresponding to the tube current being between 5.0 mA and 8.0 mA. Further, in FIG. 5, a dotted line B represents brightness of the lamp 21 (shown in FIG. 2) when the AC voltage waveform of the burst mode driving method shown in FIG. 4 is applied thereto. For example, the burst mode driving method provides a brightness range of 140 nit to 390 nit corresponding to the tube current being between 4.0 mA to 8.0 mA.

Thus, although the lamp driven by the continuous mode driving method provides higher brightness, the continuous mode driving method has a disadvantage in that the power consumption of the inverter circuit 32 (shown in FIG. 2) and the backlight unit 30 (shown in FIG. 1) is high because the high AC voltage waveform is continuously supplied to the lamp 21. However, the burst mode driving method provides a limited brightness range. Moreover, the liquid crystal display device according to the related art has another disadvantage in that brightness within the dot hatched area C cannot be realized.

SUMMARY OF THE INVENTION

Accordingly, the present invention is directed to an apparatus and a method for driving a lamp of a liquid crystal display device that substantially obviate one or more of the problems due to limitations and disadvantages of the related art.

Accordingly, it is an object of the present invention to provide a driving apparatus and a method of a lamp of a liquid crystal display device that provide an improved range of control for the lamp brightness.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the apparatus for driving a lamp of a liquid crystal display device includes a control signal generator generating a switching control signal, a waveform modulator modulating at least an amplitude of the switching control signal to generate a modulated switching control signal, and an AC waveform generator converting a supply voltage based on the modulated switching control signal to generate an AC waveform for driving the lamp, the AC waveform including at least two different peak-to-peak amplitudes within a time period.

In another aspect, the method for driving a lamp of a liquid crystal display device includes the steps of: generating a switching control signal, modulating at least an amplitude of the switching control signal, and generating an AC waveform for driving the lamp by converting a supply voltage based on the modulated switching control signal, the AC waveform including at least two different peak-to-peak amplitudes within a time period.

In yet another aspect, the liquid crystal display device includes a liquid crystal display panel, a backlight unit having a lamp irradiating light on the liquid crystal display panel, and a lamp driving circuit generating an AC waveform to be applied the lamp, the AC waveform including at least two different peak-to-peak amplitudes within a time period.

to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 6:
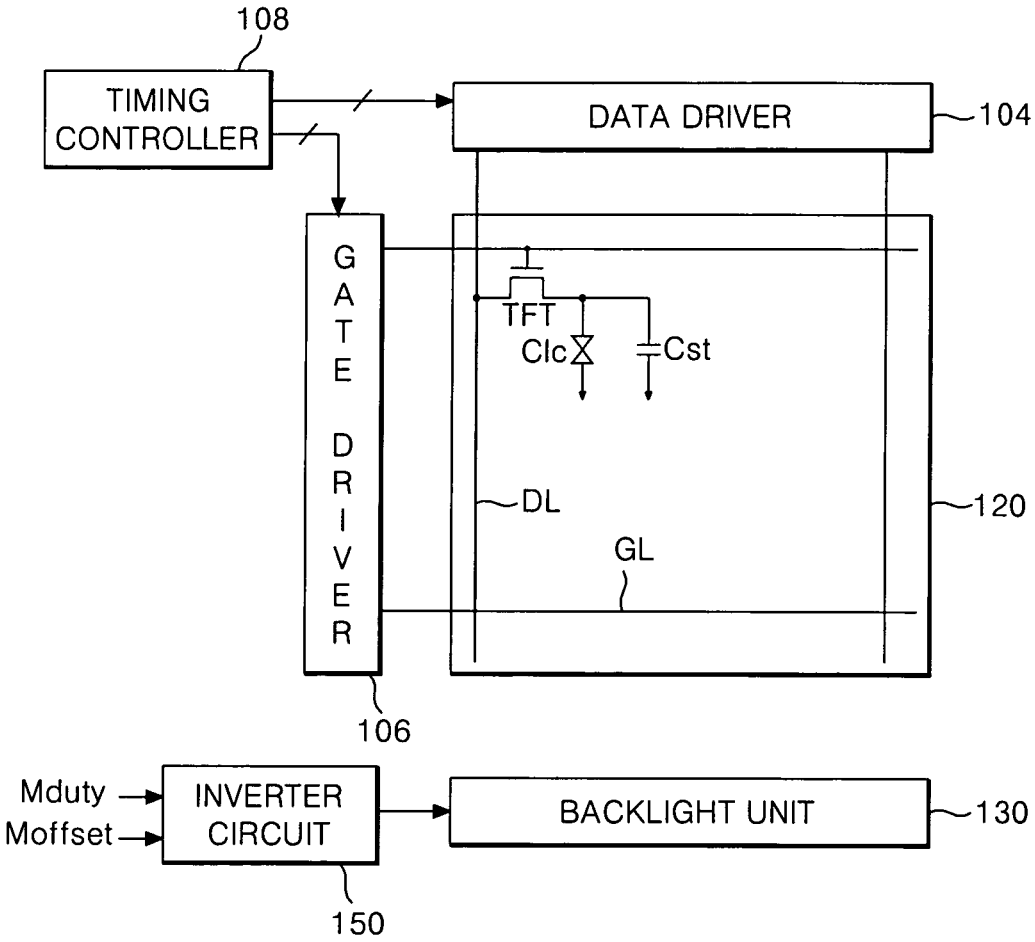
FIG. 6 is a schematic block diagram illustrating a liquid crystal display device according to an embodiment of the present invention.

FIG. 6 is a schematic block diagram illustrating a liquid crystal display device according to an embodiment of the present invention. In FIG. 6, a liquid crystal display device includes a liquid crystal display panel 120 having liquid crystal cells Clc arranged in a matrix-like manner at intersections between data lines DL and gate lines GL, a data driver 104 for applying data signals to the data lines DL, a gate driver 106 for applying gate signals to the gate lines GL, a backlight unit 130 for irradiating light to the liquid crystal display panel 120, an inverter circuit 150 for driving the backlight unit 130, and a timing controller 108 for controlling the data driver 104 and the gate driver 106.

The liquid crystal display panel 120 has liquid crystal formed between an upper substrate and a lower substrate and includes a spacer (not shown) for fixedly maintaining the distance between the upper substrate and the lower substrate. A color filter, a common electrode, and a black matrix (not shown) may be formed on the upper substrate of the liquid crystal display panel 120.

On the lower substrate of the liquid crystal display panel 120, each of the liquid crystal cells Clc includes a thin film transistor TFT. The thin film transistor TFT applies a data signal from a respective one of the data lines DL to the liquid crystal cell Clc in response to a scanning signal from a respective one of the gate lines GL. In particular, the thin film transistor TFT is turned on when a scanning signal from the respective gate line GL, e.g., a gate high voltage, is supplied thereto, thereby supplying a pixel signal from the respective data line DL to the liquid crystal cell Clc. Further, the thin film transistor TFT is turned off when a gate low voltage from the respective gate line GL is supplied thereto, thereby maintaining the pixel signal charged in the liquid crystal cell Clc.

In FIG. 6, the liquid crystal cell Clc is expressed as a capacitor equivalent and also includes a pixel electrode (not shown) connected to the thin film transistor TFT and facing common electrode with the liquid crystal therebetween. Further, each of the liquid crystal cells Clc includes a storage capacitor Cst for stably maintaining the charged pixel signal until the next pixel signal is charged. The storage capacitor Cst is formed between the previous gate line and the pixel electrode. As a result, in the liquid crystal cell Clc, the arrangement state of the liquid crystal having dielectric anisotropy is changed in accordance with the pixel signal charged through the thin film transistor TFT to control light transmissivity, such that the liquid crystal cell realizes gray.

The timing controller 108 may re-align a digital video data supplied from a digital video card (not shown) by red, green and blue. The video data re-aligned by the timing controller 108 are supplied to the data driver 104. Also, the timing controller 108 generates a data control signal and a gate control signal by use of a horizontal/vertical synchronization signal. The data control signal supplied to the data driver 104 may include a dot clock, a source shift clock, a source output enable and a polarity inversion signal. The gate signal supplied to the gate driver 106 may include a gate start pulse, a gate shift clock, and a gate output enable.

In addition, the data driver 104 supplies the pixel signals of one line portion to the data lines DL every horizontal line in response to the data control signal from the timing controller 108. In particular, the data driver 104 may convert the digital video data from the timing controller 108 into an analog video signal by use of a gamma voltage from a gamma voltage generator (not shown). The data driver 104 may includes a plurality of data drive ICs which are separately driving the data lines DL. Further, the gate driver 106 sequentially supplies the gate high voltage to the gate lines GL in response to the gate control signal from the timing controller 108, and supplies the gate low voltage in the remaining period when the gate high voltage is not supplied to the gate lines GL.

Furthermore, the inverter circuit 150 may receive a duty modulation signal Mduty and an amplitude modulation signal Moffset from an external source to generate a driving voltage or a driving current for driving the backlight unit 130. The inverter circuit 150 thus controls the driving of the backlight unit 130 in accordance with the duty modulation signal Mduty and the amplitude modulation signal Moffset. Then, the backlight unit 130 generates light corresponding to the driving voltage or the driving current from the inverter circuit 150 to irradiate light to the liquid crystal display panel 120.

Figure 7:
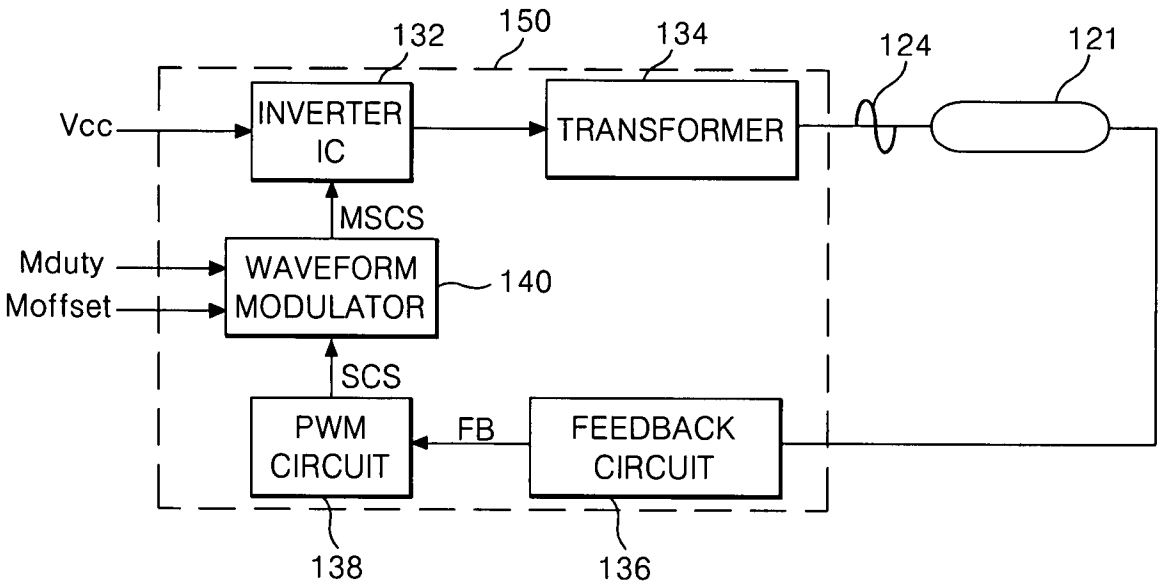
FIG. 7 is a schematic block diagram of the inverter circuit shown in FIG. 6.

FIG. 7 is a schematic block diagram of the inverter circuit shown in FIG. 6. As shown in FIG. 7, the backlight unit 130 (shown in FIG. 6) includes at least one lamp 121 to generate light. The lamp 121 includes a glass tube, an inert gas within the glass tube, a high voltage electrode at one end of the glass tube, and a low voltage electrode at another end of the glass tube. The inert gas is charged in the glass tube, and phosphorus is spread over the inner wall of the glass tube. For example, if a high AC voltage waveform 124 is applied from the inverter circuit 150 to the lamp 121, electrons are emitted from the low voltage electrode to collide with the inert gas inside the glass tube, thereby increasing the amount of electrons by geometrical progression. The increased electrons cause electric current to flow in the inside of the glass tube, thus the inert gas is excited to emit ultraviolet ray. The ultraviolet ray collides with the luminous phosphorus spread over the inner wall of the glass tube to then emit a visible ray.

The inverter circuit 150 includes an inverter IC 132, a transformer 134, a feedback circuit 136, a pulse width modulation (PWM) circuit 138, and a waveform modulator 140. The inverter IC 132 includes at least one switching device (not shown) to convert a supply voltage Vcc supplied from a voltage source (not shown) into an AC waveform. The AC waveform is supplied to the transformer 134 to form the high AC voltage waveform 124, and the high AC voltage waveform 124 then is supplied to the backlight unit 130 (shown in FIG. 6) to drive the lamp 121. In particular, the AC waveform is induced by the winding ratio of the primary winding and the secondary winding of the transformer 134, and the high AC voltage waveform 124 induced by the secondary winding of the transformer 134 is supplied to the high voltage electrode of the lamp 121.

In addition, the feedback circuit 136 detects a tube current of the lamp 121 and outputs a feedback signal FB to the PWM circuit 138. The feedback circuit 136 may include a resistor, a diode and the like, such that the feedback signal FB corresponds to the tube current. Further, the PWM circuit 138 generates a switching control signal SCS to control the switching device of the inverter IC 132 based on the feedback signal FB and supplies the switching control signal SCS to the waveform modulator 140.

The waveform modulator 140 modulates the switching control signal SCS in accordance with the duty modulation signal Mduty and the amplitude modulation signal Moffset. In particular, the waveform modulator 140 modulates the switching control signal SCS and outputs a modulated switching control signal MSCS to the inverter IC 132, such that the high AC voltage waveform 124 has varying maximum amplitudes within one time period.

Figure 8:
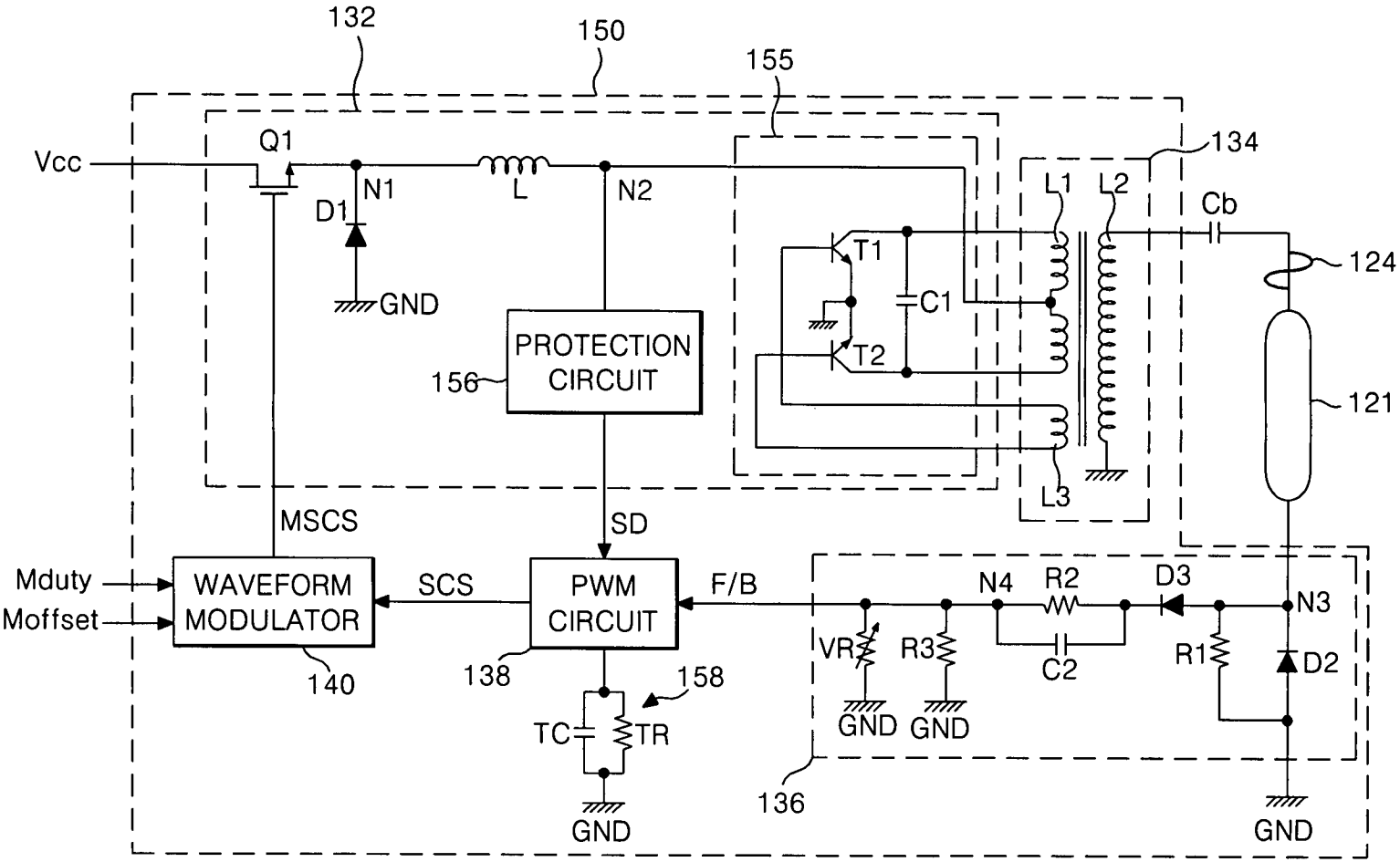
FIG. 8 is a circuit diagram illustrating the inverter circuit shown in FIG. 6.

FIG. 8 is a circuit diagram illustrating the inverter circuit shown in FIG. 6. As shown in FIG. 8, the feedback circuit 136 includes a second diode D2 having a cathode connected to a low voltage electrode of the lamp 121 and an anode connected to a ground voltage source GND, a first resistor R1 connected to the second diode D2 in parallel, a third diode D3 having an anode connected to a third node that is between the cathode of the second diode D2 and the low voltage electrode of the lamp 121, a second resistor R2 and a second capacitor C2 connected in parallel between the PWM circuit 138 and a cathode of the third diode D3, an impedance matching resistor R3 connected between the ground voltage source GND and a fourth node N4 which is between the PWM circuit 138 and a common node of the second resistor R2 and the second capacitor C2, and a tube current control resistor VR connected between the fourth node N4 and the ground voltage source GND and connected in parallel to the impedance matching resistor R3. In particular, the feedback circuit 136 rectifies a voltage at the third node by the third diode D3, levels it by the second resistor R2 and the second capacitor C2, and changes the voltage value by the tube current control resistor VR, thereby supplying the feedback signal FB to the PWM circuit 138.

In addition, the PWM circuit 138 generates the switching control signal SCS to switch the switching device of the inverter IC 132 based on the feedback signal FB supplied from the feedback circuit 136. The inverter circuit 150 may further include a triangular wave generation circuit 158 that generates a triangular wave using a capacitor TC and a resistor TR connected in parallel between the PWM circuit 138 and the ground voltage source GND, and supplies the generated triangular wave to the PWM circuit 138. Accordingly, the PWM circuit 138 generates the switching control signal SCS using the feedback signal FB and the triangular wave supplied from the triangular wave generation circuit 158.

Further, the waveform modulator 140 controls the duty of an on-time period Ton of the modulated switching control signal MSCS supplied to the inverter IC 132 in response to the duty modulation signal Mduty and controls the reference voltage level Vref of an off-time period Toff of the modulated switching control signal MSCS in response to the amplitude modulation signal Moffset. For example, the waveform modulator 140 modulates the switching control signal SCS supplied from the PWM circuit 138 within the range of a tube current value of the lamp 121 as recommended by a manufacturer and in accordance with the duty modulation signal Mduty and/or the amplitude modulation signal Moffset. As a result, the maximum value of the tube current supplied from the lamp 121 is not to be changed by the AC high voltage waveform 124. Further, the tube current supplied to the lamp 121 by the AC high voltage waveform 124 is not higher than the recommended maximum tube current value, and the life span of the lamp 121 would not be shortened due to an overshoot instantly generated at a rising edge of the modulated switching control signal MSCS.

Moreover, the inverter IC 132 converts the supply voltage Vcc supplied from the voltage source into the AC waveform using a switching device Q1. In particular, the switching device Q1 is connected between the transformer 134 and the voltage source and is switched by the modulated switching control signal MSCS. The inverter IC 132 further includes a high frequency oscillating circuit 155 connected between the switching device Q1 and the transformer 134, and a coil L connected between the switching device Q1 and the high frequency oscillating circuit 155. As a result, the switching device Q1 switches the supply voltage Vcc to the high frequency oscillating circuit 155 in response to the modulated switching control signal MSCS supplied from the waveform modulator 140.

The inverter IC 132 also includes a first diode D1 connected between the ground voltage source GND and a first node N1 that is between the switching device Q1 and the coil L, to stably maintain the voltage that runs through the switching device Q1. The inverter IC 132 further includes a protection circuit 156 connected between the PWM circuit 138 and a second node N2 that is between the coil L and the high frequency oscillating circuit 155, to generate a shut down signal SD. The shut down signal SD is applied to the PWM circuit 138 for shutting down the inverter IC 13 in accordance with the voltage on the second node N2.

In addition, the high frequency oscillating circuit 155 includes a first transistor T1 connected to one end of a primary winding L1 of the transformer 134, a second transistor T2 connected to the other end of the primary winding L1 of the transformer 134, and a first capacitor C1 connected to both ends of the primary winding L1 of the transformer 134. Further, a base terminal of the first transistor T1 is connected to one end of an auxiliary winding L3 of the transformer 134, and a base terminal of the second transistor T2 is connected to the other end of the auxiliary winding L3 of the transformer 134. Each emitter terminal of the first and second transistors T1, T2 is connected to the ground voltage source GND.

The first terminal of the coil L is connected to a collector terminal of the switching device Q1, and the second terminal is connected to the center of the primary winding L1 of the transformer 134. Thus, the coil L forms an LC resonance with the first capacitor C of the high frequency oscillating circuit 155.

Accordingly, the inverter IC 132 supplies the supply voltage Vcc to the primary winding L1 of the transformer 134 in accordance with the switching of the switching device Q1 that is driven by the modulated switching control signal MSCS from the waveform modulator 140. The inverter IC 132 also generates the LC resonance of the coil L and the first capacitor C1 of the high frequency oscillating circuit 155 by an induction voltage induced to the auxiliary winding L3 by the supply voltage Vcc supplied to the primary winding L1 of the transformer 134. In particular, the first and second transistors T1, T2 alternately perform the operation of turning-on/off and turning-off/on to induce the AC high voltage waveform 124 to the secondary winding L2 of the transformer 134. Further, the AC high voltage waveform 124 induced to the secondary winding L2 of the transformer 134 is supplied to the lamp 121 through a balance capacitor Cb.

As a result, the lamp driving apparatus and method of the liquid crystal display device according to an embodiment of the present invention control the on-time period Ton of the AC high voltage waveform 124 supplied to the lamp 121 in accordance with the modulated signal Mduty, and controls the reference voltage level of the off-time period Toff of the switching control signal MSCS supplied to the lamp 121 in accordance with the amplitude modulation signal Moffset. Thus, the off section of the burst-mode AC waveform for driving the lamp 121 disappears. That is, the AC high voltage waveform 124 does not remain zero even during the off-time period. Instead, the AC high voltage waveform 124 supplied to the lamp continuously oscillates even during the off-time period but at a lower amplitude, thereby enabling the improved control of brightness of the lamp 121.

Figure 9:
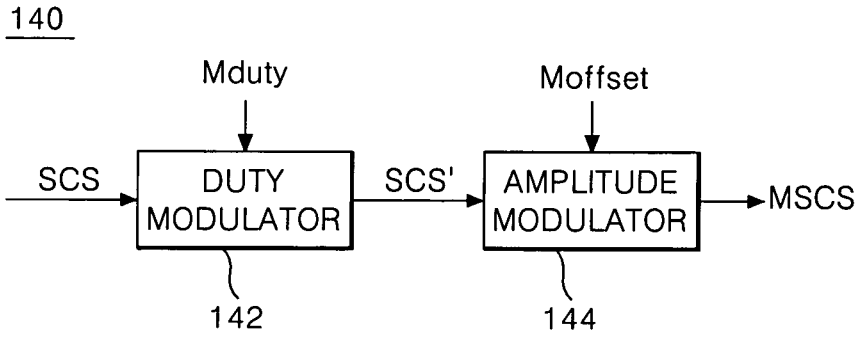
FIG. 9 is a schematic block diagram of the waveform modulator shown in FIGS. 7 and 8.

FIG. 9 is a schematic block diagram of the waveform modulator shown in FIGS. 7 and 8. As shown in FIG. 9, the waveform modulator 140 may include a duty modulator 142 and an amplitude modulator 144. The duty modulator 142 modulates an on-time portion Ton of the switching control signal SCS based on the duty modulation signal Mduty to generate a first switching control signal SCS'. The duty modulator 142 further modulates a reference voltage level Vref of the first switching control signal SCS' based on the amplitude modulation signal Moffset to generate the modulated switching control signal MSCS.

Figure 10:
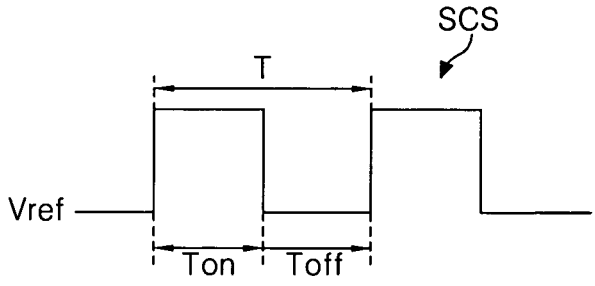
FIG. 10 is a waveform diagram illustrating a switching control signal generated by the pulse width modulation circuit shown in FIG. 7.

FIG. 10 is a waveform diagram illustrating a switching control signal generated by the pulse width modulation circuit shown in FIG. 7. As shown in FIG. 10, the switching control signal SCS has an on-time period Ton and an off-time period Toff within each time period T. In particular, the reference voltage level Vref during the on-time period Ton is high, and the reference voltage level Vref during the off-time period Toff is low.

Figure 11:
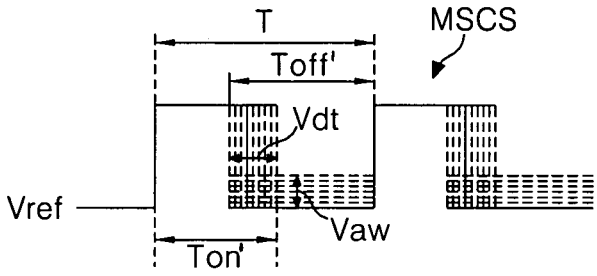
FIG. 11 is a waveform diagram illustrating a modulated switching control signal generated by the waveform modulator shown in FIG. 7.

FIG. 11 is a waveform diagram illustrating a modulated switching control signal generated by the waveform modulator shown in FIG. 7. As shown in FIG. 11, the modulated switching control signal MSCS includes an on-time period Ton' and an off-time period Toff within each time period T corresponding to the switching control signal SCS (shown in FIG. 10). In particular, the length of the on-time period Ton' of the modulated switching control signal MSCS may be longer or shorter in comparison with the on-time period Ton of the switching control signal SCS. For example, the duty modulator 142 (shown in FIG. 9) may modulate the switching control signal SCS within a duty difference range Vdt, and the on-time period Ton' modulated by the duty modulator 142 is set in a range of about 30% to 100% of the designated period T in accordance with a desired brightness control range. Thus, the modulated switching control signal MSCS may transit from a high Vref voltage to a low Vref voltage along any one of the vertical dashed lines shown in FIG. 11.

In addition, the reference voltage Vref during the off-time period Toff of the modulated switching control signal MSCS may be higher in comparison with the off-time period Toff of the switching control signal SCS. For example, the amplitude modulator 144 (shown in FIG. 9) may modulate the switching control signal SCS by an amplitude difference Vaw, and the reference voltage Vref during the off-time period Toff of the modulated switching control signal MSCS is higher than the voltage during the off-time period Toff of the switching control signal SCS. Thus, the modulated switching control signal MSCS may have a voltage along any one of the horizontal dashed lines shown in FIG. 11.

Figure 12:
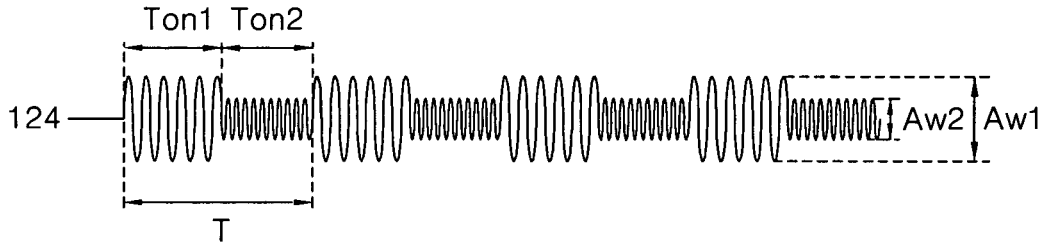
FIG. 12 is a waveform diagram illustrating an AC high voltage waveform for driving a lamp according to an embodiment of the present invention.

FIG. 12 is a waveform diagram illustrating an AC high voltage waveform for driving a lamp according to an embodiment of the present invention. In FIG. 12, an AC high voltage waveform 124 has a first on-time period Ton1 and a second on-time period Ton2 during each time period T. The first and second on-time period Ton1 and Ton2 may have the same length, and the second on-time period Ton2 may immediately follow the first on-time period Ton1. In addition, the AC high voltage waveform 124 has a first peak-to-peak amplitude Aw1 during the first on-time period Ton1 and a second peak-to-peak amplitude Aw2 during the second on-time period Ton2. The second peak-to-peak amplitude Aw2 may be less than the first peak-to-peak amplitude Aw1.

Figure 13:
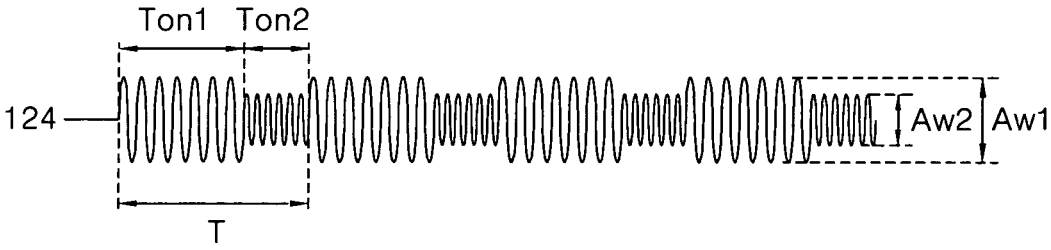
FIG. 13 is a waveform diagram illustrating an AC high voltage waveform for driving a lamp according to another embodiment of the present application.

FIG. 13 is a waveform diagram illustrating an AC high voltage for driving a lamp according to another embodiment of the present application. In FIG. 13, an AC high voltage waveform 124 has a first on-time period Ton1 and a second on-time period Ton2 during each time period T. The first and second on-time period Ton1 and Ton2 may have different lengths, and the second on-time period Ton2 may immediately follow the first on-time period Ton1. In addition, the AC high voltage waveform 124 has a first peak-to-peak amplitude Aw1 during the first on-time period Ton1 and a second peak-to-peak amplitude Aw2 during the second on-time period Ton2. The second peak-to-peak amplitude Aw2 may be less than the first peak-to-peak amplitude Aw1.

Figure 1:
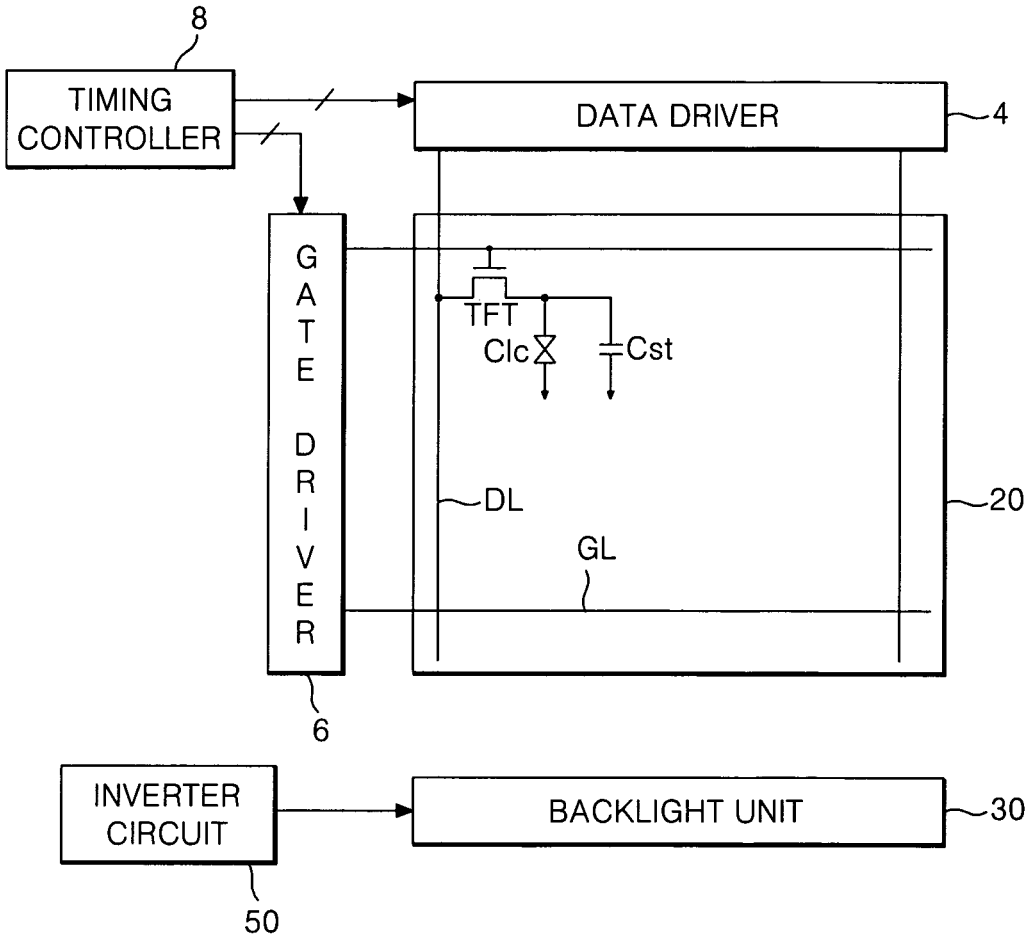
FIG. 1 RELATED ART
FIG. 1 is a schematic block diagram illustrating a liquid crystal display device according to the related art.
Figure 2:
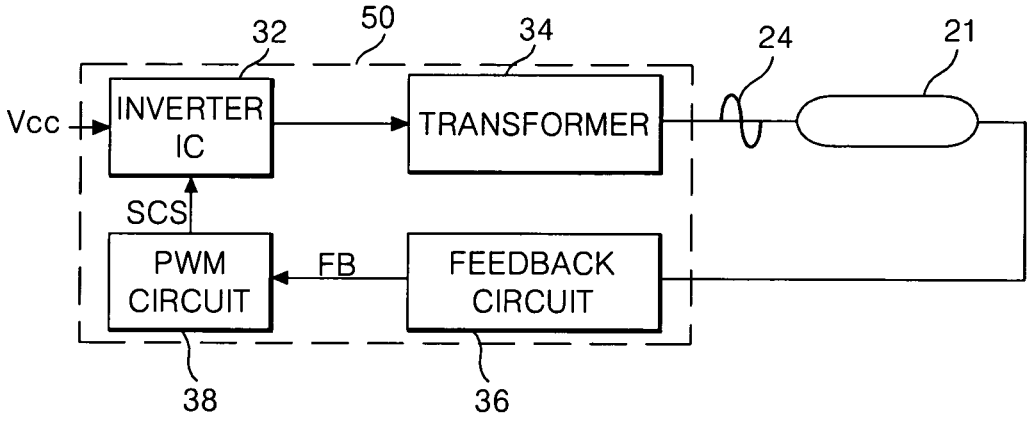
FIG.2 RELATED ART
FIG. 2 is a schematic block diagram of the inverter circuit shown in FIG. 1.
Figure 3:
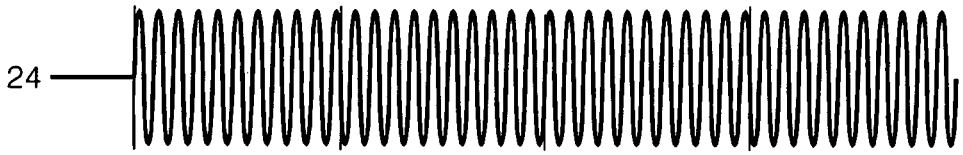
FIG. 3 RELATED ART
FIG. 3 is a waveform diagram illustrating an AC voltage waveform for driving the lamp shown in FIG. 2 in a continuous mode.
Figure 4:
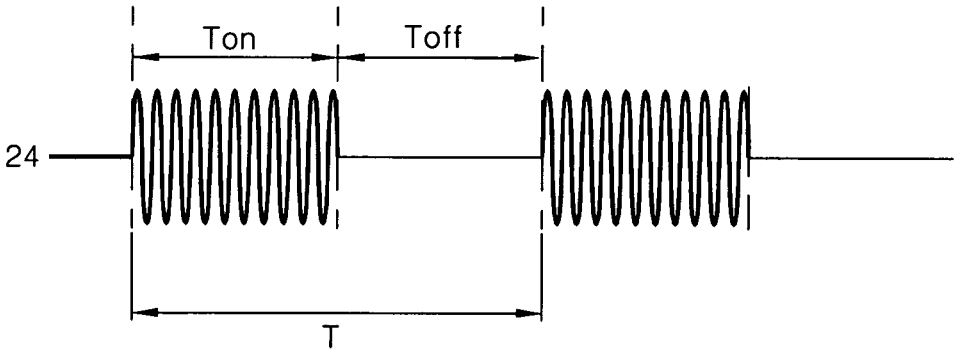
FIG. 4 RELATED ART
FIG. 4 is a waveform diagram illustrating an AC voltage waveform for driving the lamp shown in FIG. 2 in a burst mode.
Figure 5:
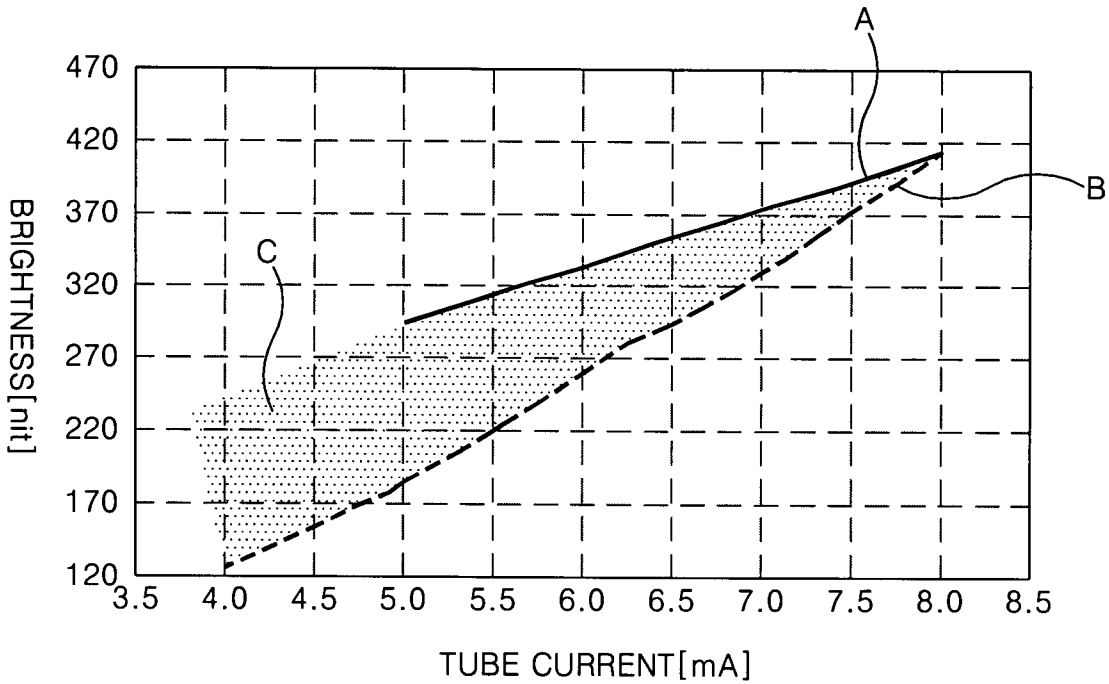
FIG. 5 RELATED ART
FIG. 5 is a graph illustrating brightness of the lamp when the AC voltage waveforms shown in FIGS. 3 and 4 are applied thereto.

Accordingly, the lamp driving apparatus and method of the liquid crystal display device according to an embodiment of the present invention generates the AC high voltage waveform supplied to the lamp in accordance with the duty modulation signal and/or the amplitude modulation signal using an inverter circuit. Thus, the off section of the related-art burst-mode AC waveform disappears and the AC high voltage waveform does not remain zero even during the off-time period. Instead, the AC high voltage waveform supplied to the lamp continuously oscillates even during the off-time period but at a lower amplitude, thereby enabling the improved control of brightness of the lamp. Hence, the lamp realizes brightness within the dotted hatched area C (shown in FIG. 5).

Further, the lamp driving apparatus and method of the liquid crystal display device according to the embodiment of the present invention controls the amplitude of the on-time and/or the off-time of the switching control signal that is to switch the switching device of the inverter IC in accordance with the duty modulation signal and the amplitude modulation signal. Thus, the AC high voltage waveform having the first and second on-times is applied to the lamp. As a result, the brightness control range of the lamp is improved by the first and second on-times of the lamp.

It will be apparent to those skilled in the art that various modifications and variations can be made in the apparatus and method for driving a lamp of a liquid crystal display device of the present invention without departing from the spirit or scope of the invention. Thus, it is intended that the present invention covers the modifications and variations of this invention provided they come within the scope of the appended claims and their equivalents.

What is claimed is:

1. An apparatus for driving a lamp of a liquid crystal display device, comprising:

an AC waveform generator converting a supply voltage based on a modulated switching control signal to generate an AC waveform for driving the lamp, the AC waveform including at least two different peak-to-peak amplitudes within a time period, and the AC waveform generator including an inverter integrated circuit comprising a switching device for converting the supply voltage into the AC waveform in response to the modulated switching control signal;

a control signal generator generating a switching control signal;

a waveform modulator modulating the switching control signal to generate the modulated switching control signal for controlling the switching device;

a transformer increasing voltage levels of the AC waveform and supplying the increased AC waveform to the lamp, the increased AC waveform including at least two different peak-to-peak amplitudes within the time period; and a feedback circuit detecting a tube current of the lamp and generating a feedback signal corresponding to the tube current, wherein the control signal generator generates the switching control signal for controlling the switching device based on the feedback signal, wherein the switching control signal includes an on-time portion having an amplitude greater than a reference value and an off-time portion having an amplitude equal to the reference value within each time period as determined by the control signal generator, wherein the waveform modulator further modulates the switching control signal to generate the modulated switching control signal including an on-time portion having an amplitude greater than the reference value and an off-time portion having an amplitude greater than the reference value, wherein the waveform modulator includes:

a duty modulator to change the on-time portion of the switching control signal in response to a first modulation signal;

an amplitude modulator to change the off-time portion of the switching control signal in response to a second modulation signal, wherein the off-time portion includes a waveform amplitude lower than an amplitude of the on-time portion and greater than the reference value, wherein the duty modulator fixes the on-time portion of the AC waveform of high voltage supplied to the lamp in accordance with the first modulation signal and the modulated switching control signal, and at the same time, the amplitude modulator controls the amplitude of the off-time portion of the AC waveform of high voltage supplied to the lamp in accordance with the second modulation signal and the modulated switching control signal, wherein within each time period, the increased AC waveform includes a first AC waveform pattern having a first peak-to-peak amplitude during a first sub-period and a second AC waveform pattern having a second peak-to-peak amplitude during the second sub-period in accordance with the modulated switching control signal, the second peak-to-peak amplitude being less than the first peak-to-peak amplitude and greater than zero, wherein the switching control signal includes first and second sub-periods within each time period, and the waveform modulator modulates lengths of the first and second sub-periods and the amplitude of the switching control signal to generate the modulated switching control signals, wherein the on-time portion modulated by the duty modulator is set in a range 30% to 100% within each time period, wherein the inverter integrated circuit includes a high frequency oscillating circuit connected between the switching device and the transformer and a coil connected between the switching device and the high frequency oscillating circuit, the switching device switching the supply voltage to the high frequency oscillating circuit in response to the modulated switching control signal, wherein the inverter integrated circuit further includes a protection circuit connected between the control signal generator and a second node that is between the coil and the high frequency oscillating circuit, to generate a shut down signal for shutting down the inverter integrated circuit in accordance with the voltage on the second node.

2. A liquid crystal display device, comprising:

a liquid crystal display panel;

a backlight unit having a lamp irradiating light on the liquid crystal display panel; and a lamp driving circuit generating a high AC waveform to be applied to the lamp, the high AC waveform including at least two different peak-to-peak amplitudes within a time period, wherein within each time period, the high AC waveform includes a first AC waveform pattern having a first peak-to-peak amplitude during a first sub-period and a second AC waveform pattern having a second peak-to-peak amplitude during the second sub-period, the second peak-to-peak amplitude being less than the first peak-to-peak amplitude, wherein the lamp driving circuit includes:

an AC waveform generator converting a supply voltage based on a modulated switching control signal to generate an AC waveform for driving the lamp, the AC waveform including at least two different peak-to-peak amplitudes within a time period, and the AC waveform generator including an inverter integrated circuit comprising a switching device for converting the supply voltage into the AC waveform in response to the modulated switching control signal;

a control signal generator generating a switching control signal;

a waveform modulator modulating the switching control signal to generate the modulated switching control signal for controlling the switching device;

a transformer increasing voltage levels of the AC waveform and supplying the increased AC waveform to the lamp; and a feedback circuit detecting a tube current of the lamp and generating a feedback signal corresponding to the tube current, wherein the control signal generator generates the switching control signal for controlling the switching device based on the feedback signal, wherein the switching control signal includes an on-time portion having an amplitude greater than a reference value and an off-time portion having an amplitude equal to the reference value within each time period as determined by the control signal generator, wherein the waveform modulator further modulates the switching control signal to generate the modulated switching control signal including an on-time portion having an amplitude greater than the reference value and an off-time portion having an amplitude greater than the reference value, wherein the waveform modulator includes:

a duty modulator to change the on-time portion of the switching control signal in response to a first modulation signal; and an amplitude modulator to change the off-time portion of the switching control signal in response to a second modulation signal, wherein the off-time portion includes a waveform amplitude lower than an amplitude of the on-time portion and greater than the reference value, wherein the duty modulator fixes the on-time portion of the AC waveform of high voltage supplied to the lamp in accordance with the first modulation signal and the modulated switching control signal, and at the same time, the amplitude modulator controls the amplitude of the off-time portion of the AC waveform of high voltage supplied to the lamp in accordance with the second modulation signal and the modulated switching control signal, wherein within each time period, the increased AC waveform includes a first AC waveform pattern having a first peak-to-peak amplitude during a first sub-period and a second AC waveform pattern having a second peak-to-peak amplitude during the second sub-period in accordance with the modulated switching control signal, the second peak-to-peak amplitude being less than the first peak-to-peak amplitude and greater than zero, wherein the switching control signal includes first and second sub-periods within each time period, and the waveform modulator modulates lengths of the first and second sub-periods and the amplitude of the switching control signal to generate the modulated switching control signal, wherein the on-time portion modulated by the duty modulator is set in a range 30% to 100% within each time period, wherein the inverter integrated circuit includes a high frequency oscillating circuit connected between the switching device and the transformer and a coil connected between the switching device and the high frequency oscillating circuit, the switching device switching the supply voltage to the high frequency oscillating circuit in response to the modulated switching control signal, wherein the inverter integrated circuit further includes a protection circuit connected between the control signal generator and a second node that is between the coil and the high frequency oscillating circuit, to generate a shut down signal for shutting down the inverter integrated circuit in accordance with the voltage on the second node.

* * * * *